United States Patent [19]

Strongin

[11] 4,087,933

[45] May 9, 1978

[54] DOLL HAVING VIEWABLE INTERNAL ORGANS WITH MANUALLY OPERATED BELLOWS AND PUMP

[75] Inventor: Ned Strongin, Baldwin, N.Y.

[73] Assignee: Mattel, Inc., Hawthorne, Calif.

[21] Appl. No.: 761,123

[22] Filed: Jan. 21, 1977

[51] Int. Cl.[2] ..... A63H 13/02

[52] U.S. Cl. ..... 46/44; 35/17; 46/119

[58] Field of Search ..... 35/17; 46/116, 117, 46/118, 119, 264, 41, 44

[56] References Cited

U.S. PATENT DOCUMENTS

| | | | |
|---|---|---|---|
| 2,483,034 | 9/1949 | Braeg | 35/17 |
| 2,971,272 | 2/1961 | Barlow | 35/17 |
| 2,988,823 | 6/1961 | Rosenbloom | 35/17 |
| 3,014,312 | 12/1961 | Convertine | 46/264 |
| 3,154,881 | 11/1964 | Elwell | 35/118 X |
| 3,178,833 | 4/1965 | Gulbranson et al. | 35/17 |
| 3,376,659 | 4/1968 | Asin et al. | 35/17 |
| 3,426,449 | 2/1969 | Van Noy | 35/17 |
| 3,704,528 | 12/1972 | Lewis | 35/17 |
| 3,748,366 | 7/1973 | Rader et al. | 35/17 |
| 3,999,309 | 12/1976 | Gonzalez | 35/17 |

*Primary Examiner*—F. Barry Shay
*Attorney, Agent, or Firm*—John G. Mesaros; Max E. Shirk; Stephen L. King

[57] ABSTRACT

A doll having internal organs of the chest and stomach cavities viewable through a transparent structure forming a part of the front of the torso, the torso being hollow and having a transverse partition therein supporting an inflatable one-piece member configured to simulate a heart and a pair of lungs, the partition also supporting coiled transparent tubing simulating abdominal cavity organs. The reverse side of the partition contains a bellows for inflating the one-piece member and pump means connected in closed-loop fluid relation with the tubing, the bellows and pump means being operable simultaneously by a depressible portion of the back of the doll torso to inflate the heart and lungs and pass fluid through the tubing.

7 Claims, 8 Drawing Figures

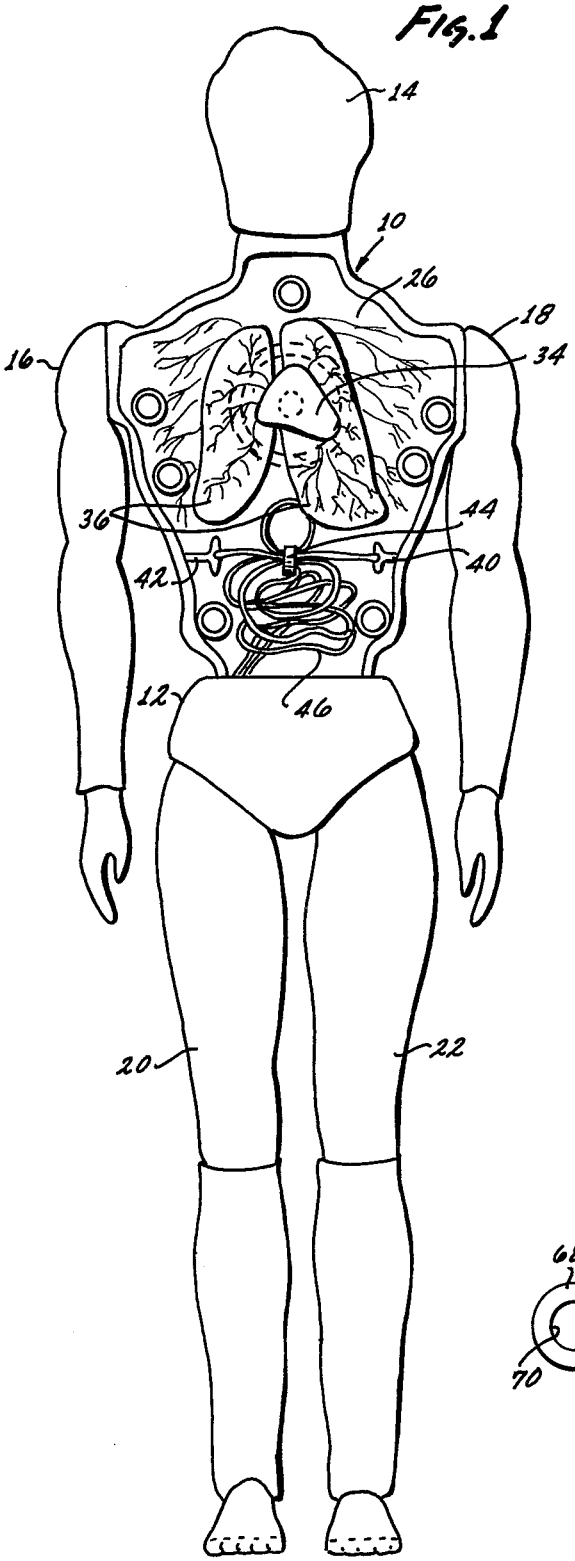
Fig. 1
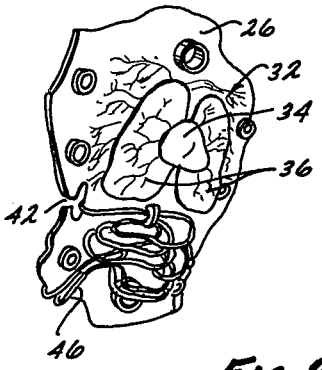
Fig. 2
Fig. 3
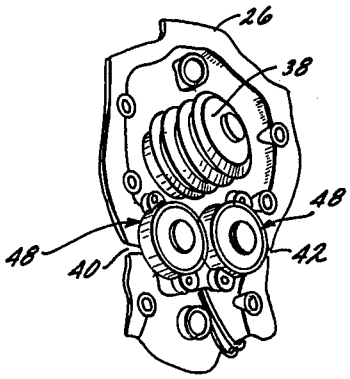
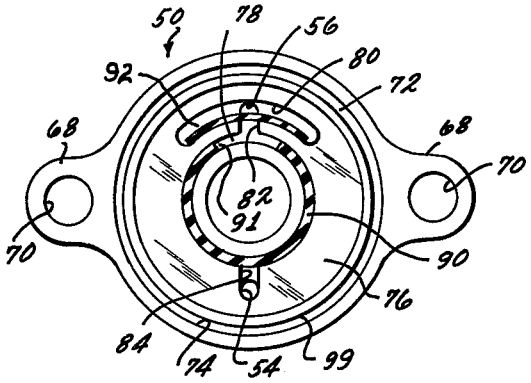
Fig. 8

DOLL HAVING VIEWABLE INTERNAL ORGANS WITH MANUALLY OPERATED BELLOWS AND PUMP

CROSS-REFERENCE TO RELATED APPLICATION

This application is related to Ser. No. 761,122 filed Jan. 21, 1977 entitled "Pump" by Robert Frederick Schroeder, such application being assigned to the assignee of the present invention.

BACKGROUND OF THE INVENTION

The background of the invention will be discussed in two parts:

1. Field of the Invention

This invention relates to dolls and more particularly to dolls having simulated internal organs viewable through a transparent structure.

2. Description of the Prior Art

Dolls having some sort of animation to simulate a human function provide fascination to children. Some forms of animation include for example, walking, talking, rotating heads or the like. One animated doll shown in U.S. Pat. No. 3,154,881 issued to Elwell on Nov. 3, 1964, provides a sophisticated structure to simulate the interrelated timing between simulated circulatory and respiratory organs operated by cranks and cams under control of a motor to cyclically collapse and expand bellows-type pumps. The lungs and heart of the doll may be viewed either through a transparent cover or by removing an opaque cover. The structure is both complicated in operation and expensive in construction.

It is an object of this invention to provide a new and improved doll having viewable internal organs.

It is another object of this invention to provide a doll having organs of the chest and stomach cavities manually operable to simulate working organs.

It is a further object of this invention to provide a simple, inexpensive animated doll.

SUMMARY OF THE INVENTION

The foregoing and other objects of the invention are accomplished by providing a doll having the chest cavity and stomach cavity of the torso viewable through a transparent structure forming a part of the front of the torso. A transversely positioned partition divides the torso into a front section containing the simulated organs and a rear section which is not viewable through the partition, the rear portion having secured thereto a bellows and a pump, both being actuable simultaneously by means of a depressible or hinged portion configured to form a part of the back of the torso. A one-piece inflatable member configured to simulate a heart and a pair of lungs is secured to the viewable side of the partition, the member being in fluid communication with the bellows. The pump has an inlet end and an outlet end secured to opposite ends of a length of transparent tubing which is coiled and bunched and secured to the viewable side of the partition in the abdominal cavity to simulate abdominal organs, the pump and tubing conducting colored fluid therethrough in response to actuation of the pump.

Other objects, features and advantages of the invention will become apparent upon a reading of the specification when taken in conjunction with the drawings in which like-reference characters refer to like elements in the several views.

BRIEF DESCRIPTION OF THE DRAWINGS

FIG. 1 shows a front view of a doll according to the invention having a transparent structure forming a part of the torso;

FIG. 2 is a perspective view of the front of the partition showing the simulated organs mounted thereon;

FIG. 3 is a perspective view of the reverse side of the partition showing the bellows and pump means mounted thereon;

FIG. 8 is a top plan view of the bottom member of the two-part pump shown in FIG. 5, showing in cross section the skirt portion of the top member thereof.

DESCRIPTION OF THE PREFERRED EMBODIMENT

Figure 4:
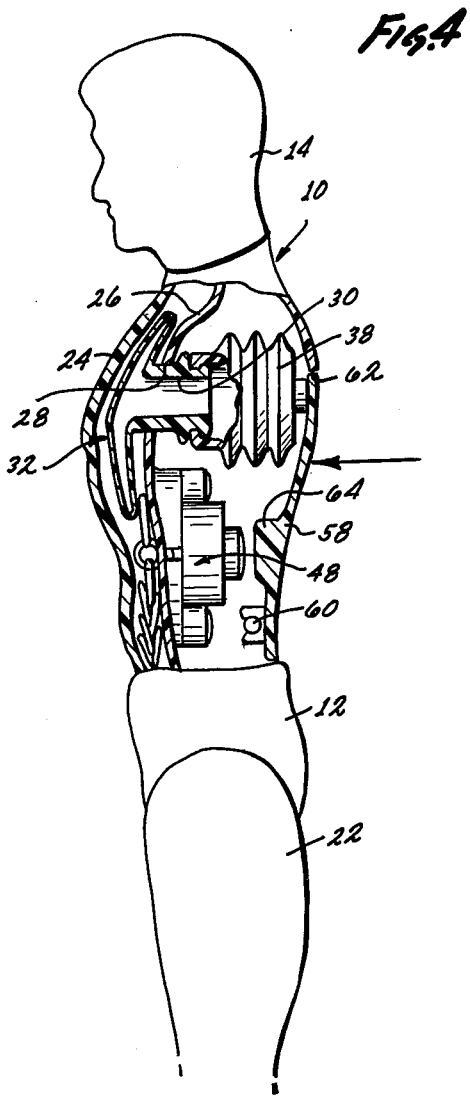
FIG. 4 is a partial cross sectional side view of the doll of FIG. 1.

Referring now to the drawings and particularly to FIGS. 1 and 4, there is shown a figure toy or doll having an upper torso generally designated 10 having the lower end thereof secured to a lower torso 12. A head 14 is suitably secured to the upper torso 10, as is a pair of arms 16 and 18. Similarly suitably secured to the lower torso 12 is a pair of legs 20 and 22. The torso may consist of one piece rather than the upper and lower torsos 10 and 12 respectively, but in any event, a transparent structure 24 is configured to form the front portion of the upper torso 10 to permit viewing of the chest cavity and abdominal cavity of the doll.

Extending transversely within the interior of the upper torso 10 is a partition 26 which is suitably configured to divide the interior of the upper torso 10 into a front part and a rear part, the front part being between the front, or viewable surface of partition 26 and the rear part being between the rear surface of partition 26 and the interior of the back of the upper torso 10. As can be seen in FIG. 4, the partition 26 has a contour which closely approximates the contour of the transparent structure 24 with the space therebetween being adapted for receiving certain members which simulate internal organs of the abdominal cavity and chest cavity which are viewable through the transparent structure 24.

Centrally disposed within the partition 26 at a point intermediate the shoulder portions of arms 16 and 18, there is an aperture 28 for receiving therethrough a relatively rigid tubular portion 30 of a one-piece member generally designated 32, the member 32 being configured to simulate a heart 34 and a pair of lungs 36, the member 32 being inflatable, as will hereinafter be discussed. Disposed rearwardly of partition 26 and connected to the tubular portion 30 of member 32 is a bellows 38 in fluid communication with member 32, the fluid in this case being air. Upon depression of bellows 38 the member 32 inflates and upon release of bellows 38 the member 32 deflates thereby simulating the pulsating action of the heart 34 and lungs 36.

Figure 5:
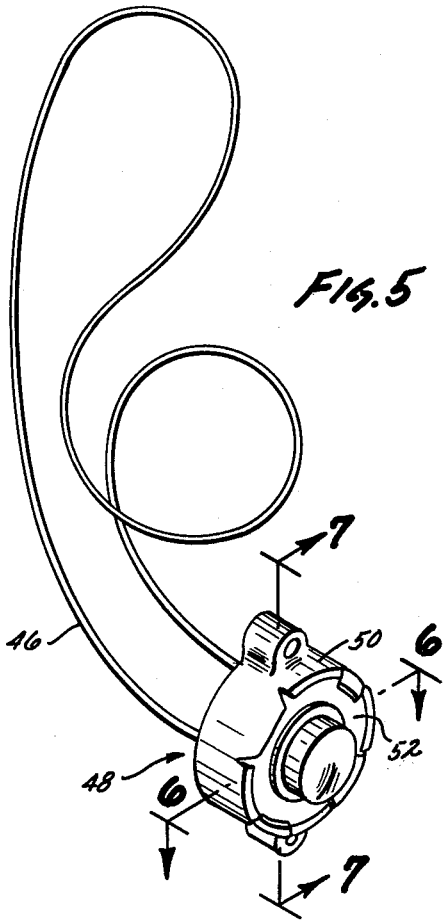
FIG. 5 is a perspective view of a pump connected to the transparent tubing.

As better illustrated in FIGS. 1 and 2, the partition 26 is provided with a pair of keyhole slots 40 and 42 on a line approximating the demarcation between the chest cavity and stomach cavity. At a point intermediate the slots 40 and 42 there is also provided an integral hook member 44 on partition 26, the slots 40 and 42 and hook 44 being adapted to retain coiled, bunched, transparent tubing 46 on the front surface of the partition 26, the tubing 46 simulating blood vessels or the like within the abdominal cavity. Referring now to FIG. 5, the transparent tubing 46 is connected to a novel positive displacement single direction of flow pump 48 which is formed of two parts, a main body 50 and a diaphragm member 52. The pump body 50 is provided with an inlet end 54 and an outlet end 56, each receiving one end of transparent tubing 46 in closed-loop relation for flow of fluid therethrough in a single direction.

Referring now to FIGS. 3 and 4, there is shown a first and second pump 48, each being connected to the rear surface of partition 26 adjacent opposing slots 40 and 42, each pump 48 having a section of transparent tubing 46 connected thereto as shown in FIG. 5, with the two pieces of transparent tubing 46 being suitably coiled and bunched to simulate the blood vessels or the like shown in FIG. 1. Each pump 48 is in fluid communications with its respective transparent tubing 46 and may be filled or charged with a mixture of colored liquid and air causing separation of the liquid into segments with alternating segments of air which, upon actuation of pump 48, causes the liquid segments to move in a given direction within the tubing 46. By providing two pumps 48, the tubing 46 associated with each of the pumps 48 may be filled with a liquid-air mixture with different colored liquids.

As best illustrated in FIG. 4, the back portion of the upper torso 10 has a pivotable backplate member 58 suitably hinged at 60 within the lower portion of upper torso 10, the plate 58 being configured to form a part of the back of the upper torso 10, and of course, having the periphery thereof configured to fit within a matingly configured opening 62 in the back of upper torso 10. The plate 58 is biased outwardly to the position shown in FIG. 4 by means of the engagement thereof on the inner surface by bellows 38. The inner lower surface of plate 58 is provided with a pair of projections 64 (only one of which is shown), each of the projections 64 being adapted to engage a pump 48 during pivotal movement of plate 58 so that upon depression of plate 58 against the force of bellows 38, the bellows 38 is actuated simultaneously with both pumps thereby providing simultaneous movement of the air-liquid mixtures within the transparent tubing 46 along with inflation of the one-piece inflatable member 32 thereby resulting in expansion of the heart 34 and lungs 36. Upon release of plate 58, it is pivoted clockwise to the position shown in FIG. 4 under the resilient biasing force of pump 48 and bellows 38.

Figure 6:
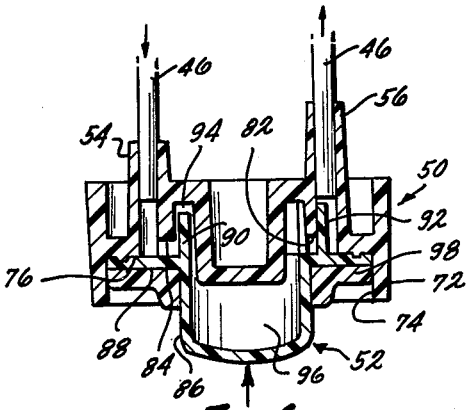
FIG. 6 is a cross sectional view of the pump of FIG. 5 taken along line 6—6 thereof.
Figure 7:
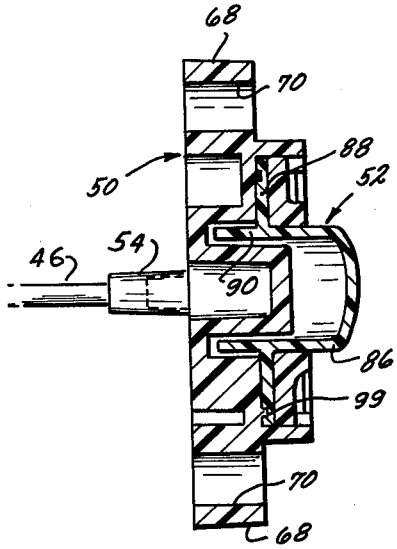
FIG. 7 is a cross sectional view of the pump of FIG. 5 taken along line 7—7 thereof.

Referring now to FIGS. 6, 7 and 8, the construction and operation of the three-piece pump will be described in detail. The main pump body 50 is a one-piece molded plastic structure and as shown in FIG. 8 is circular in form with outwardly extending fastening projections 68 which are diametrically opposed and have aperture 70 extending therethrough for suitably securing to the transverse partition 26. Extending upwardly from the mounting side of pump body 50 about the periphery of the main portion thereof is a cylindrical wall 72 forming a recess 74 adapted to receive therein the diaphragm member 52. The surface 76 of recess 74 is generally planar and is provided with an annular groove 78 concentric with the cylindrical wall 72. Concentric with groove 78 and intermediate groove 78 and wall 72 is a second groove 80, which is the outlet groove, the groove 80 being arcuate in form and having centrally positioned therein the outlet aperture 56. The annular groove 78 is in fluid communication with the outlet groove 80 by means of a radially extending groove segment 82 interconnecting the two grooves. Similarly, the annular groove 78 is in fluid communication with the inlet aperture 54 by means of radially extending groove segment 84. As can be seen in FIG. 6, groove segments 82 and 84 are approximately one-third the depth of annular groove 78, the depth of groove 78 being about equal to that of arcuate groove 80.

The diaphragm 52, as illustrated in FIGS. 6 and 7 is a one-piece member, preferably formed of a resilient material such as rubber or a resilient plastic capable of being deformed through repeated usage. The diaphragm 52 has a dome-shaped portion 86 having a peripheral flange 88 thereabout. Depending from the flange 88 is a skirt portion 90 (see also FIG. 8) which is generally cylindrical except for a cutaway portion 91. Also downwardly depending from the flange 88 is an arcuate tongue portion 92. As shown in FIG. 6, in the assembled position the flange 84 of diaphragm 52 is fitted against surface 76 of recess 74 with the skirt portion 90 extending into the annular groove 78 and the tongue portion 92 extending into outlet groove 80 in close engagement with the arcuate surface near interconnecting groove 82. As best illustrated in FIG. 6, the lower edge of skirt portion 90 is spaced from the walls and adjacent bottom surface of annular groove 78 as indicated at reference numeral 94 to form a flow path for the incoming liquid-air mixture through aperture 54 through connecting groove 84 through the space between skirt portion 90 and the adjacent surface of the annular groove 78 into the chamber 96 within the dome-shaped portion 86. The diaphragm member 52 is suitably retained within recess 74 by means of a snap locking annular connecting member 98 urging flange 88 against a sealing ridge 99.

In operation, a portion of the annular groove 78 operates as an inlet groove while the arcuate groove 80 is essentially the outlet groove. The flexible skirt portion 90 in proximity to interconnecting groove 84 in fluid communication with inlet aperture 54 operates as an inlet check valve, while the tongue portion 92 of diaphragm member 52 acts as a check valve for the outlet aperture 56. The skirt portion 90 has the same diameter as dome-shaped portion 86 and in operation, depression of the dome-shaped portion 86 in the direction indicated by the arrow (that is toward the main body 50), flexes the skirt portion 90 adjacent inlet interconnecting groove 84 outwardly toward the outer surface of annular groove 78 thereby closing the flow path through inlet aperture 74. Simultaneously the fluid contained within chamber 96 flows from chamber 96 through interconnecting aperture 82 around tongue portion 92, the lower edge of which is flexed outwardly toward the other surface of arcuate groove 80 thereby providing a fluid flow path from chamber 96 through interconnecting groove 82 into arcuate groove 80 and out through outlet aperture 56. When the dome-shaped portion 86 is released the tongue portion 92 returns to its sealing position against the inner surface of outlet groove 80 to thereby prevent the reverse flow of fluid into chamber 96. Simultaneously as the dome-shaped portion 86 returns to its normal position the skirt portion 90 is released to the position shown in FIG. 6 thereby permitting fluid flow into chamber 96 from the fluid within the tubing 46 through inlet aperture 54, through interconnecting groove 84 about the periphery of skirt portion 90 through the recess 94 into the chamber 96.

It is to be understood that although FIG. 8 shows the skirt portion 90 as completely filling the groove 78, FIG. 8 was drawn for illustrative purposes to show the cross-sectional configurations of the skirt portion 90 and the tongue portion 92. The dimensional relationship between the skirt portion 90 of the diaphragm 52 within the groove 78 is best illustrated in FIGS. 6 and 7 which shows the skirt portion 90 spaced from opposing sidewalls of the groove 78. The approximate dimensions of the parts are as follows: the depth of groove 78 is 0.180 inches while the depth of skirt portion 90 is 0.150 inches thus forming a space about the bottom of groove 78 of approximately 0.030 of an inch. Also as can be seen in FIG. 6, the depth of groove 82 is less that the overall length of tongue portion 92 to provide an effective check valve arrangement. The wall thickness of the skirt 90 is .030 inch while the width of the annular groove 78 is approximately .088 inch. With the skirt 90 positioned within the groove 78 the spacing on either side of the wall thereof would be about equal. Similarly the thickness of tongue portion 92 is 0.030 inch with arcuate groove 80 being 0.085 inch in width. In the assembled condition tongue portion 92 sealingly abuts against the inner surface of groove 80.

In the embodiment illustrated the main body 50 and locking member 98 are preferably made of a rigid plastic while diaphragm 52 is constructed from a thin wall or flexible polyvinylchloride plastic material. Since both the skirt portion 90 and tongue portion 92 are arcuately configured upon depression of the dome-shaped portion 86 the lower extremities of the skirt 90 and tongue 92 are both flexed outwardly. As best seen in FIG. 6 the check valves are formed by the skirt 90 operating in conjunction with groove segment 84 and by the tongue 92 operating in conjunction with groove segment 82, each groove segment being positioned in the flow path direction in advance of the coacting tongue or skirt with one groove segment "open" and the other "closed". This "opening" or "closing" alternates with depression or release of dome-shaped portion 86, thereby pumping fluid within chamber 96 in a single direction.

Essentially there has been shown a positive displacement single flow direction pump composed of two parts and a locking member, the two parts being the main body 50 and the diaphragm member 52. The arrangement and construction of the parts is such that the overall diameter of the main pump body 50 is slightly less than one inch while the overall depth, exclusive of the nipple extensions for the inlet and outlet apertures, is approximately 4/10 of an inch resulting in a very compact miniaturized pump suitable for many applications where economy is a prime objective. Due to the compact nature of the pump 48, two of the pumps are able to be fitted on the partition 26 along with the bellows 38 to permit two closed-loop tubing/pump assemblies to be utilized, each having a different colored liquid carried therethrough to provide fascination to the child using the toy. While there has been shown and described a preferred embodiment it is to be understood various other adaptations and modifications may be made within the spirit and scope of the invention.

What is claimed is:

1. In a doll, the combination comprising:

a hollow torso member having a transparent front section through which the chest and stomach cavity may be viewed, said torso having an enlarged opening in the rear thereof;

a partition secured within said torso member, said partition dividing the torso interior into front and rear sections, said partition having an aperture therethrough;

a one-piece inflatable member configured to simulate pulsating chest organs, said inflatable member being positioned in to simulate front section of said torso and being secured to said partition by a portion thereof extending through said aperture;

bellows means in said rear section of said torso in fluid communication with said portion of said inflatable member;

transparent coiled tubing positioned on said partition in said front section of said torso and having the ends thereof in said rear section;

pump means mounted in said rear section in fluid communication with the ends of said tubing for passage therethrough of a fluid mixture; and means within said enlarged opening of said torso for simultaneously actuating said bellows means and said pump means whereby to simulate action of internal organs of the stomach and chest cavities.

2. The combination according to claim 1 wherein said one-piece inflatable member is configured to simulate a heart and a pair of lungs.

3. The combination according to claim 2 wherein said means within said enlarged opening is a hinged member.

4. The combination according to claim 3 wherein said hinged member is contoured to form a portion of the back of the torso.

5. The combination according to claim 4 wherein said pump means is secured to said partition.

6. The combination according to claim 5 wherein the fluid mixture in said tubing is a mixture of air and a colored liquid.

7. The combination according to claim 6 wherein the transparent section of said torso is contoured in the shape of a stomach and chest.

* * * * *

UNITED STATES PATENT OFFICE

CERTIFICATE OF CORRECTION

Patent No. 4,087,933 Dated May 9, 1978

Inventor(s) Ned Strongin

It is certified that error appears in the above-identified patent and that said Letters Patent are hereby corrected as shown below:

At Col. 6, Line 22, in Claim 1, line 12 thereof, after the phrase "being positioned in" delete "to simulate" and insert therefor ---the---.

Signed and Sealed this

*Fifth* Day of *December 1978*

[SEAL]

*Attest:*

RUTH C. MASON
*Attesting Officer*

DONALD W. BANNER
*Commissioner of Patents and Trademarks*